United States Patent [19]

Doty

[11] Patent Number: 4,966,297

[45] Date of Patent: Oct. 30, 1990

[54] FOOD AND BEVERAGE SNACK TRAY

[76] Inventor: Robert W. Doty, 536 N. Spoonbill Dr., Sarasota, Fla. 33577

[21] Appl. No.: 480,139

[22] Filed: Feb. 14, 1990

Related U.S. Application Data

[63] Continuation of Ser. No. 383,175, Jul. 20, 1989, abandoned, which is a continuation-in-part of Ser. No. 328,107, Mar. 23, 1989, abandoned, which is a continuation-in-part of Ser. No. 250,146, Sep. 28, 1988.

[51] Int. Cl.[5] ..... A47G 23/06

[52] U.S. Cl. ..... 220/23.83; 206/564; 294/172

[58] Field of Search ..... 220/23.83, 23.86, 83; 206/561, 564, 565, 557; 294/172

[56] References Cited

U.S. PATENT DOCUMENTS

| | | | |
|---|---|---|---|
| D. 204,071 | 3/1966 | Earl | D44/10 |
| D. 210,614 | 3/1968 | Douglas | D44/10 |
| D. 270,324 | 8/1983 | French | D7/70 |
| 2,295,860 | 9/1942 | Oliver | 294/172 |
| 3,401,858 | 9/1968 | White et al. | 220/23.83 |
| 3,498,470 | 3/1970 | Thomas | 181/282 |
| 3,504,832 | 4/1970 | Corvetti | 206/557 X |
| 3,915,371 | 10/1975 | Crabtree | 206/564 X |
| 3,941,286 | 3/1976 | Perkinson | 206/557 X |
| 4,219,144 | 8/1980 | Hagelberg | 206/564 X |
| 4,461,396 | 7/1984 | Harper | 206/565 X |
| 4,744,597 | 5/1988 | Bauman et al. | 294/172 |

*Primary Examiner*—Steven M. Pollard
*Attorney, Agent, or Firm*—A. W. Fisher, III

[57] ABSTRACT

A food and beverage snack tray comprising a substantially flat tray bottom having an inclined peripheral side wall extending upwardly from the periphery thereof including a beverage container receptacle and food receiving area separated by an arcuate separator element and a pair of digit slots formed in the inclined peripheral side wall to selectively receive the thumb and index finger of a user's hand to permit the user to grasp a beverage container disposed within the beverage container receptacle adjacent the digit slots and to receive food in the food receiving area isolating the food from the beverage while holding the food and beverage snack tray.

9 Claims, 6 Drawing Sheets

FOOD AND BEVERAGE SNACK TRAY

CROSS-REFERENCE

This is a continuation application of co-pending application serial number 383,175 filed July 20, 1989, now abandoned, which is a co-pending continuation-in-part application of co-pending application serial number 328,107, filed Mar. 23, 1989, now abandoned which is a continuation-in-part application of co-pending application serial number 250,146, filed Sept. 28, 1988.

BACKGROUND OF THE INVENTION

1. Field of the Invention

A food and beverage snack tray comprising a beverage container receptacle and food receiving area having a grasping means formed thereon to hold the food and beverage snack tray in one hand.

2. Description of the Prior Art

Service of food and beverage at informal gatherings such as cocktail parties, receptions and picnics is generally awkward. Normally a person holds a beverage container in one hand and a plate of food in the other hand.

U.S. Pat. No. 4,744,597 teaches a service tray for holding food and drink to be held in one hand. The tray bottom defines an arcuate gripping edge along a portion of the periphery thereof The edge is dimensioned to permit a user of the tray to grasp a beverage container between the thumb and index finger of one hand of the user. The user's remaining fingers support the underside surface of the tray bottom which enables the user to grip the tray. The tray also includes an upwardly extending C-shaped sidewall about the remaining portion of the tray bottom's periphery.

U.S. Re. 27,688 (U.S. Pat. No. 3,401,858) shows a service tray including a bottom having a substantially vertical peripheral wall formed about the periphery thereof. The wall at one end of the tray includes a pair of transversely spaced, oval openings for receiving the thumb and index finger of a user's hand so as to embrace a beverage container resting on the bottom adjacent the oval openings. The remainder of the tray bottom is configured to receives hors d'oeuvres and the like.

U.S. Pat. No. 3,498,470 discloses a serving tray including a flat panel including a channel-shaped reinforcing rim. A raised well is provided at one corner of the tray with coaxial walls. The inner wall is stepped downwardly to form a plurality of vertically adjacent socket portions. The socket portions have side walls tapered relative to tapered cups wherein each socket portion is made successively smaller than the next adjacent socket portion to accommodate a smaller size of cup. The well walls and rim are provided with a downwardly divergent configuration enabling trays to be nested for storage.

U.S. Pat. No. 2,295,860 teaches a service tray having a bottom with peripheral rim extending upwardly therefrom having a concave curve on one edge portion. An elliptical perforation is formed through the bottom having a molding disposed adjacent the perforation such that the thumb may be inserted upwardly through the perforation with the fingers contacting the under side tray.

Additional examples of the prior art are found in U.S. Design No. 204,071; U.S. Design No. 210,614 and U.S. Design No. 270,324.

SUMMARY OF THE INVENTION

The present invention relates to a food and beverage snack tray including a beverage container receptacle and food receiving area. The food and beverage snack tray comprises a flat tray bottom having an inclined side wall extending upwardly from the periphery thereof. The beverage container receptacle is separated from the food receiving area by a separator element extending between portions of the inclined side wall adjacent the beverage container receptacle.

A tray grasping means comprising a lower reduced grasping member and upper enlarged grasping member is formed adjacent the beverage container receptacle. The tray grasping means may be cooperatively formed by a pair of digit slots formed in the inclined side wall. The length and positioning of the pair of digit slots permit the thumb and index finger when disposed therein to grip the periphery of a beverage container nesting in the beverage container receptacle. Thus, the user is able to grasp both the tray grasping means and the beverage container with thumb and index finger simultaneously.

With the food and beverage snack tray held in this manner, food items such as hors d'oeuvres may be placed in the food receiving area. The entire food and beverage snack tray including the beverage container are thus held by one hand, while the other hand is left free.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 9:
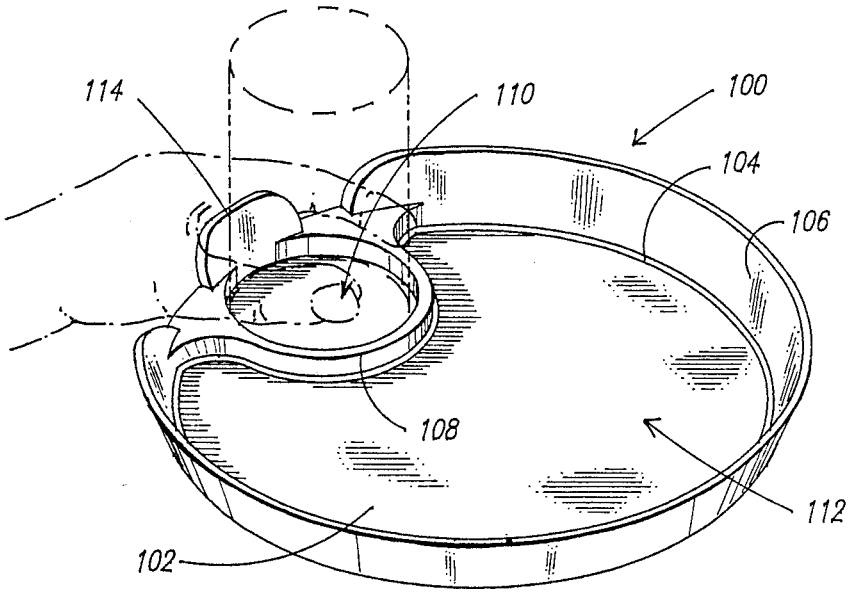
FIG. 9 is a perspective view of the prior art.
Figure 10:
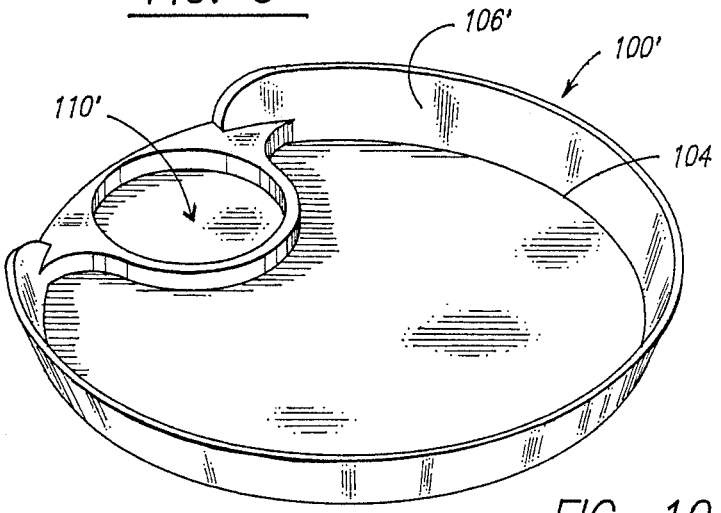
FIG. 10 is a perspective view of an alternate embodiment of the prior art.

FIGS. 9 and 10 show two of the most pertinent examples of the prior art for food and beverage snack trays as found in U.S. Pat. No. 4,744,597. Specifically, FIG. 9 shows a food and beverage snack tray generally indicated as 100 having a generally circular bottom 102 bounded along a substantial portion of the peripheral edge 104 by an integrally adjoining and upwardly extending sidewall 106. An arcuate rib 108 separates the food and beverage snack tray 100 into a shallow beverage container recess 110 and a food area 112. A backstop 114 facilitates proper positioning of the hand on the food and beverage snack tray 100. Most users picking up the food and beverage snack tray 100 for the first time will understand that the thumb of one hand is to be placed on the raised surface area adjacent one end of the backstop 114 and that the index finger of the same hand is to be placed on the raised surface area adjacent the other end of the backstop 114. As depicted in FIG. 9, the index finger illustrated in phantom is resting on one raised surface area and the thumb as depicted as is resting on the other raised surface area. The user so positioning his thumb and index finger as described will find that his remaining fingers are in contact with the underside surface of the food and beverage snack tray 100 and the user will immediately recognize that a firm grip on the food and beverage snack tray 100 can be obtained if the user uses his fingers to support the underside surface of the food and beverage snack tray. Areas adjacent the peripheral edge 104 should be spaced above the plane of bottom 102 and bottom support surface a height which enables a user to comfortably place his middle finger on the underside surface of the food and beverage snack tray 100 defined by the underside surface of bottom and the adjacent underside surface of bottom. Other means for enhancing gripping of the underside such as properly located grooves on the underside surface could also be employed within the spirit of the present invention.

FIG. 10 illustrates a food and beverage snack tray 100 without a backstop 32 as depicted in FIG. 9. Accordingly, it will be appreciated that the arcuate peripheral edge 104' is entirely unbounded. It was found quite surprisingly that removing backstop 32 did not significantly affect the user's ability to get a firm grip on the food and beverage snack tray 100' provided that beverage container recess 110' was retained. It also did not significantly affect a user's ability to grasp a beverage container between his index finger and thumb, although a first time user may have difficulty in ascertaining the correct placement of his fingers in order to properly grasp a beverage container.

Figure 1:
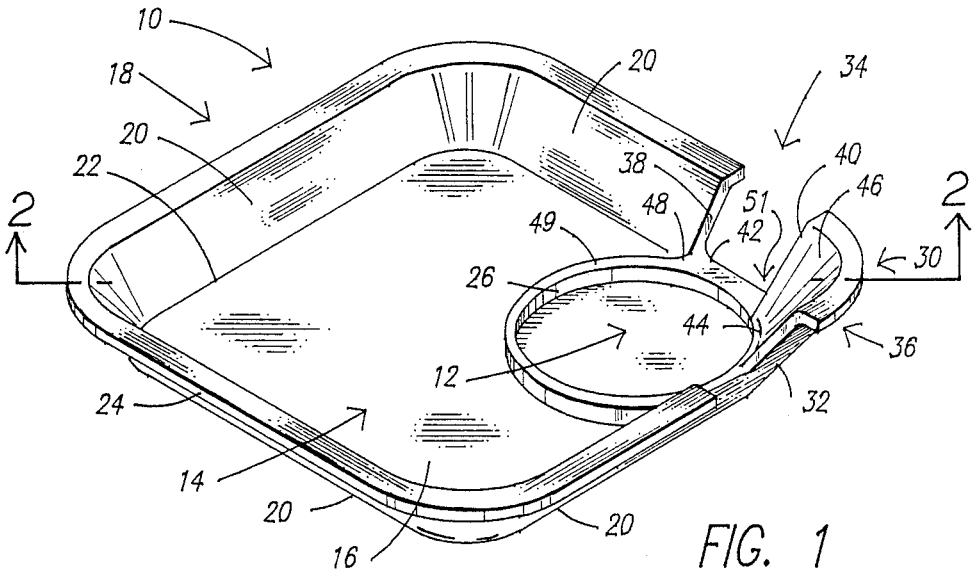
FIG. 1 is a perspective view of the food and beverage snack tray.
Figure 2:
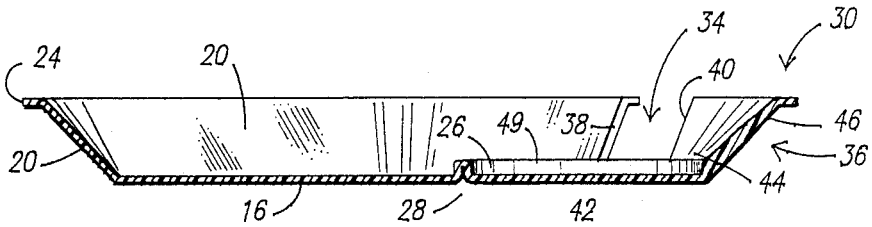
FIG. 2 is a cross-sectional side view of the food and beverage snack tray taken along line 2—2 of FIG. 1.

As best shown in FIGS. 1 and 2, the present invention relates to a food and beverage snack tray generally indicated as 10 including a beverage container receptacle and food receiving area generally indicated as 12 and 14 respectively. The food and beverage snack tray 10 may be formed of any suitable material having the required strength and rigidity such as plain fiberboard, plastic impregnated fiberboard, molded foamed plastic, wood or ceramic material. Thus, the food and beverage snack tray 10 may be constructed of relatively inexpensive material for disposable use or relatively expensive more durable material for repeated use.

The food and beverage snack tray 10 comprises a substantially rectangular flat tray bottom 16 having an inclined side wall generally indicated as 18 formed by a plurality of inclined side wall portions each indicated as 20 extending upwardly from the periphery 22 of the substantially rectangular flat tray bottom 16. A lip 24 is formed about the upper periphery of the inclined side wall 18. The beverage container receptacle 12 is separated from the food receiving area 14 by an arcuate circular separator element 26 including a stacking recess 28 formed in the lower surface thereof extending between the two inclined side wall portions 20 adjacent the beverage container receptacle 12. The arcuate separator element 26 not only increases the strength of the food and beverage snack tray 10 but also prevents any spillage or condensation from the beverage or beverage container entering food receiving area 14. Similarly, food is prevented from entering the beverage container receptacle 12 that might otherwise interfere with the placement of a beverage container therein.

A tray grasping means generally indicated as 30 is formed on the corner 32 adjacent the beverage container receptacle 12. Specifically, the tray grasping means 30 comprises a pair of digit slots each indicated as 34 formed in adjacent side wall portions 20 cooperatively forming an upwardly inclined grasping element generally indicated as 36. Each digit slot 34 comprises an outer digit slot edge, inner digit slot edge and lower digit slot edge indicated as 38, 40 and 42 respectively. The upwardly inclined grasping element 36 comprises a lower reduced grasping member and upper enlarged grasping member indicated as 44 and 46 respectively. The arcuate circular separator element 26 intersects the corresponding inclined side wall portion 20 as at 48 adjacent the corresponding outer digit slot edge 38.

As best shown in FIGS. 1 and 2, the lower digit slot edges 42 are disposed above the upper surface 49 of the arcuate circular separator element 26. In addition, the intersection of correspondingly reduced lower grasping members 44 and enlarged upper grasping member 46 form a digit receiving recess 51 to receive the thumb and index finger.

The length and positioning of the pair of digit slots 34 are such as to permit movement of the thumb and index finger when disposed therein to grip the periphery of a beverage container resting on the bottom of the beverage container receptacle 12. Thus, the user is able to simultaneously grasp the tray grasping means 30 and the beverage container with thumb and one or more fingers.

With the food and beverage snack tray 10 held in this manner, food items such as hors d'oeuvres may be placed in the food receiving area 14. The entire food and beverage snack tray 10 including the beverage container are thus held by one hand, while the other hand is left free.

Figure 5:
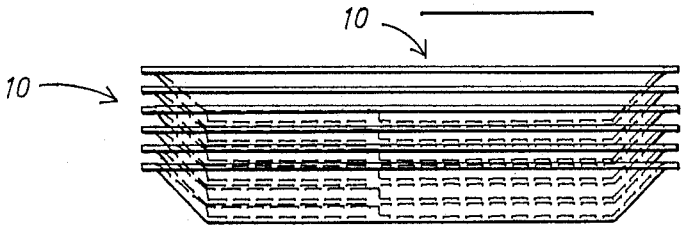
FIG. 5 is a side view of a plurality of the food and beverage snack tray stacked for storage.

The inclined side wall 18 and stacking recess 28 permit several food and beverage snack trays 10 to be stacked by nesting into each other for shipping and storage as shown in FIG. 5

Figure 3:
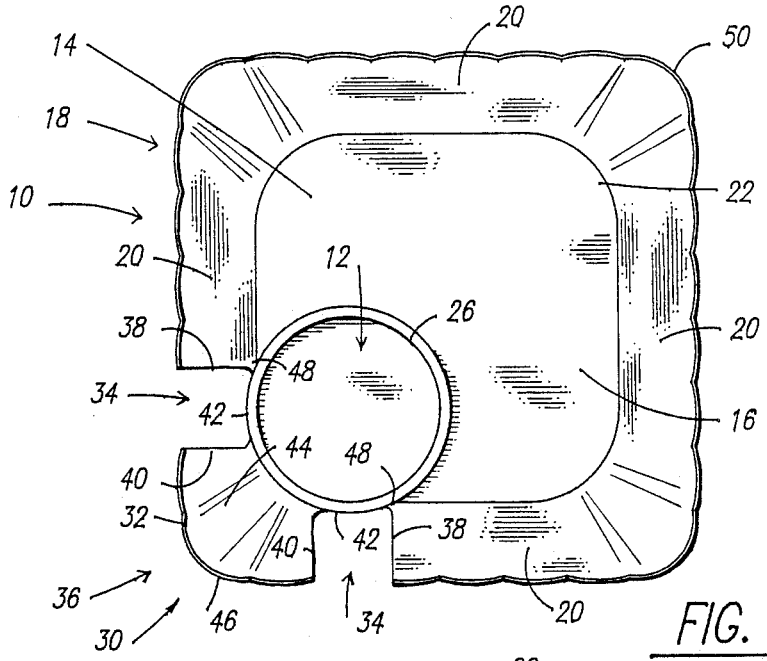
FIG. 3 is a top view of an alternate embodiment of the food and beverage snack tray.

The alternate embodiment of the food and beverage snack tray 10 shown in FIG. 3 is substantially the same as the food and beverage snack tray 10 of FIGS. 1 and 2 except that the upper periphery of the inclined side wall 18 comprises a scallop configuration indicated as 50.

Figure 4:
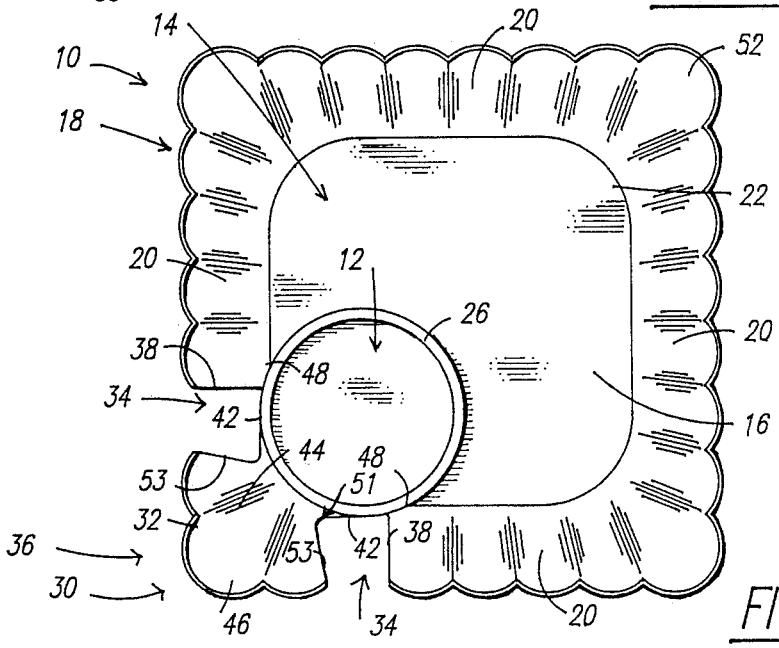
FIG. 4 is a top view of another alternate embodiment of the food and beverage snack tray.

The alternate embodiment of the food and beverage snack tray 10 shown in FIG. 4 is substantially the same as the food and beverage snack tray 10 of FIGS. 1 and 2 except that the upper periphery of the inclined side wall 18 comprises a flute configuration indicated as 52.

In addition, the upwardly inclined grasping element 36 may include an inwardly slanted inner digit slot edge 53 to form the reduced lower grasping member 44 and enlarged upper grasping member 46.

Figure 6:
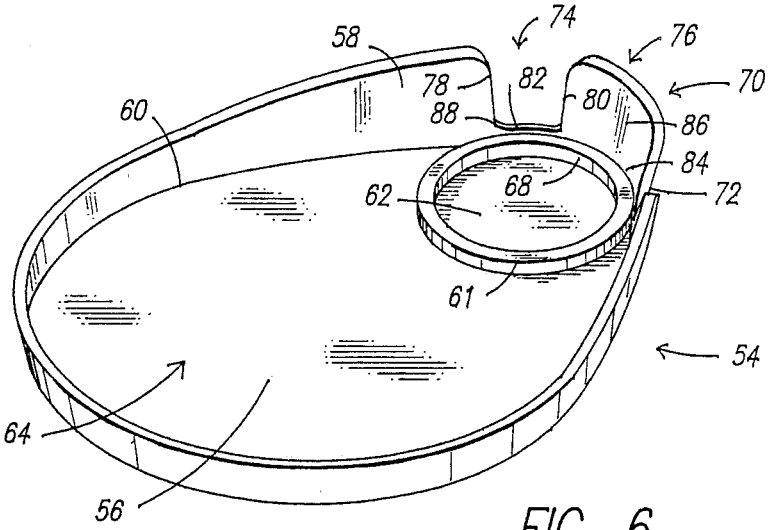
FIG. 6 is a perspective view of still another alternate embodiment of the food and beverage snack tray.

FIG. 6 shows still another alternate embodiment of a food and beverage snack tray generally indicated as 54 comprising a pear-shaped flat tray bottom 56 having an inclined side wall 58 extending upwardly from the periphery 60 thereof. A beverage container receptacle generally indicated as 62 is separated from a food receiving area generally indicated as 64 by an arcuate circular separator element 66 including a stacking recess 68 formed in the lower surface thereof extending between portions of the inclined side wall 58 adjacent the beverage container receptacle 62. A tray grasping means generally indicated as 70 is formed on the smaller end 72 of the pear-shaped flat tray bottom 56 adjacent the beverage container receptacle 62. Specifically, the tray grasping means 70 comprises a pair of digit slots each indicated as 74 formed in the inclined side wall 58 cooperatively forming an upwardly inclined grasping element generally indicated as 76. Each digit slot 74 comprises an outer digit slot edge, inner digit slot edge and lower digit slot edge indicated as 78, 80 and 82 respectively. The upwardly inclined grasping element 76 comprises a reduced lower grasping member and upper grasping member indicated as 84 and 86 respectively. The arcuate circular separator element 66 intersects the inclined side wall 56 as at 88 adjacent the outer digit slot edges 78.

The length and positioning of the pair of digit slots 74 are such as to facilitate positioning of the thumb and index finger when disposed therein to grip the periphery of a beverage container resting on the bottom of the beverage container receptacle 62. Thus, the user is able to simultaneously grasp the tray grasping means 70 and the beverage container with thumb and index finger. The otherwise the food and beverage snack tray same as food and beverage snack tray of FIGS. 1 and 2.

Figure 7:
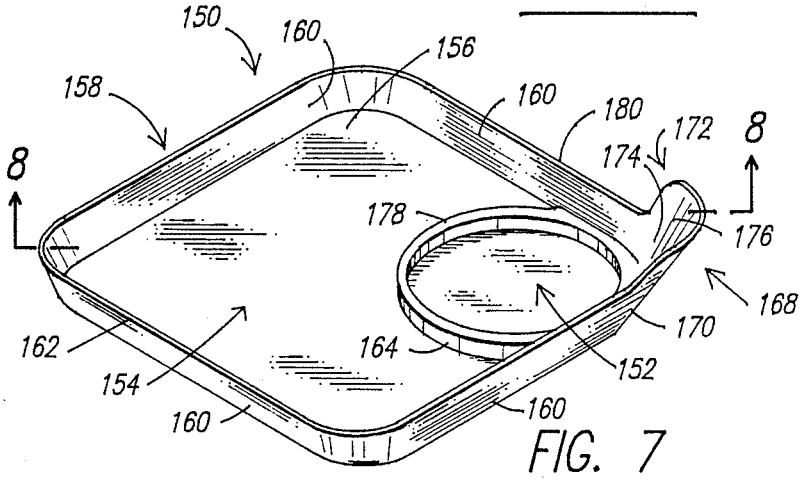
FIG. 7 is a perspective view of yet another alternate embodiment of the food and beverage snack tray.
Figure 8:
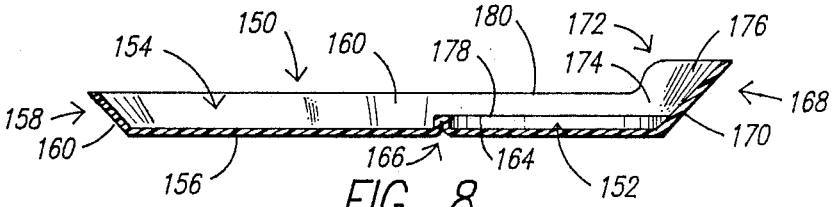
FIG. 8 is a cross-sectional side view of the food and beverage snack tray taken along line 8—8 of FIG. 7.

FIGS. 7 and 8 show yet another food and beverage snack tray generally indicated as 150 including a beverage container receptacle and food receiving area generally indicated as 152 and 154 respectively.

The food and beverage snack tray 150 comprises a substantially rectangular flat tray bottom 156 having an inclined side wall generally indicated as 158 formed by a plurality of inclined side wall portions each indicated as 160 extending upwardly from the periphery 162 of the substantially rectangular flat tray bottom 156. The beverage container receptacle 152 is separated from the food receiving area 154 by an arcuate circular separator element 164 including a stacking recess 166 formed in the lower surface thereof extending between the two inclined side wall portions 160 adjacent the beverage container receptacle 152. The arcuate circular separator element 164 not only increases the strength of the food and beverage snack tray 150 but also prevents any spillage or condensation from the beverage or beverage container entering food receiving area 154. Similarly, food is prevented from entering the beverage container receptacle 152 that might otherwise interfere with the placement of a beverage container therein.

A tray grasping means generally indicated as 168 is formed on the corner 170 adjacent the beverage container receptacle 152. Specifically, the tray grasping means 168 comprises an upwardly inclined grasping element generally indicated as 172 including a lower reduced grasping member and upper enlarged grasping member indicated as 174 and 176 respectively. The arcuate circular separator element 164 intersects the inclined side wall portions 160 adjacent the tray grasping means 168. The upper surface 178 of the arcuate circular separator element 164 is disposed below the upper edge 180 of the inclined side wall portions 160 adjacent the tray grasping means 168 such that the thumb and index finger rest thereon to grasp the beverage container in spaced relationship with the bottom of the beverage container. Thus the food and beverage snack tray 150 may be used equally as well with irregular shapes such as coffee cups and the like.

Figure 11:
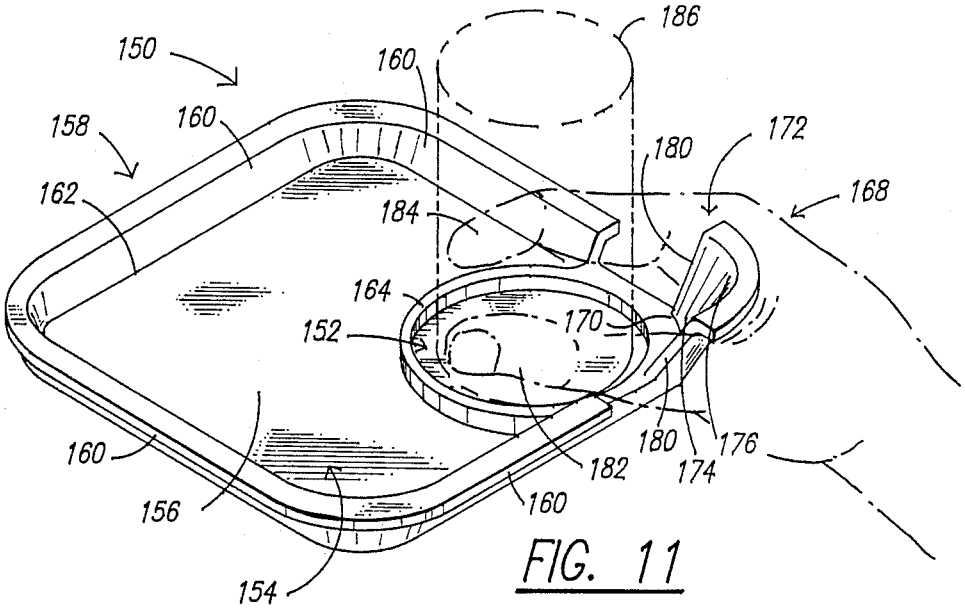
FIG. 11 is a perspective view of the food and beverage snack tray.
Figure 12:
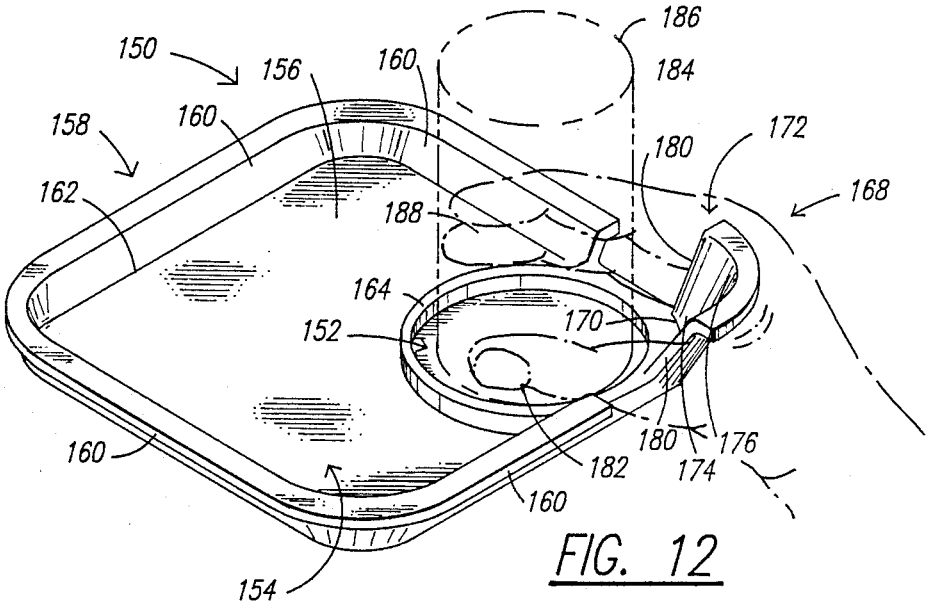
FIG. 12 is a perspective view of the food and beverage snack tray in an alternate use.

The function of the tray grasping means 168 can best be understood with reference to FIGS. 11 and 12. As shown in FIG. 11, the tray grasping means 168 is held by grasping the pair of grasping edges 180 between the thumb 182 and first finger 184 and simultaneously grasping a beverage container 186 disposed within the beverage container receptacle 152 with the grasping element resting in the space between the thumb 182 and first finger 184 of the user's hand to hold the food and beverage shack tray 150 in one hand. Alternately, as shown in FIG. 12, the user may use the first finger 184 and second finger 188 to hold the food and beverage snack tray 150 in one hand.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A food and beverage snack tray comprising a tray bottom having a peripheral side wall including a plurality of side wall portions terminating in an upper side wall surface extending upwardly from said tray bottom, said tray bottom including a beverage container receptacle and food receiving area separated by a separator element and a tray grasping means including a grasping element extending upwardly from said tray bottom adjacent said peripheral side wall, said grasping element comprising a pair of substantially straight grasping edges each disposed in substantially the same plane as the plane of the corresponding side wall portions adjacent each said substantially straight grasping edge terminating in an upper grasping surface, said upper grasping surface disposed in spaced relationships relative to said upper side wall surface, said upper grasping surface being disposed at least as high as the adjacent upper side wall surface such that a user may simultaneously grasp said grasping element between the thumb and index finger and a beverage container disposed within said beverage container receptacle adjacent said grasping element with said grasping element resting in the space between the thumb and index finger of the user's hand to hold the food and beverage snack tray in one hand.

2. The food and beverage snack tray of claim 1 wherein said grasping element comprises an upper grasping portion at least as wide as a lower grasping portion extending upwardly from said tray bottom.

3. The food and beverage snack tray of claim 2 wherein said grasping portions are inclined relative to each other such that said lower grasping portion is narrower than said upper grasping portion.

4. The food and beverage snack tray of claim 1 wherein said tray bottom is substantially flat surface.

5. The food and beverage snack tray of claim 1 wherein said peripheral side wall is inclined relative to said tray bottom.

6. The food and beverage snack gray of claim 5 wherein said separator element includes a stacking recess formed in the lower surface thereof to permit nesting of a plurality of said food and beverage snack trays.

7. The food and beverage snack gray of claim 1 wherein said separator element is substantially arcuate.

8. The food and beverage snack tray of claim 7 wherein said arcuate separator element is circular.

9. The food and beverage snack tray of claim 1 wherein said tray bottom comprises a substantially rectangular flat tray bottom having an inclined side wall formed by a plurality of inclined side wall portions extending upwardly from the periphery of each side of said substantially rectangular flat tray bottom.

* * * * *